US005579027A

United States Patent [19]

Sakurai et al.

[11] Patent Number: 5,579,027

[45] Date of Patent: Nov. 26, 1996

[54] METHOD OF DRIVING IMAGE DISPLAY APPARATUS

[75] Inventors: Katsuhito Sakurai, Atsugi; Mamoru Miyawaki, Tokyo; Akira Ishizaki, Atsugi, all of Japan

[73] Assignee: Canon Kabushiki Kaisha, Tokyo, Japan

[21] Appl. No.: 614,321

[22] Filed: Mar. 12, 1996

Related U.S. Application Data

[63] Continuation of Ser. No. 389,073, Feb. 14, 1995, abandoned, which is a continuation of Ser. No. 10,003, Jan. 27, 1993, abandoned.

[30] Foreign Application Priority Data

Jan. 31, 1992 [JP] Japan ..... 4-040586
Jan. 31, 1992 [JP] Japan ..... 4-040587

[51] Int. Cl.[6] ..... G09G 3/36

[52] U.S. Cl. ..... 345/100; 345/88; 345/99; 345/152

[58] Field of Search ..... 345/93, 92, 90, 345/88, 98, 99, 100, 208, 209, 211, 212, 213, 89, 87, 152

[56] References Cited

U.S. PATENT DOCUMENTS 4,642,619 2/1987 Togashi ..... 340/784
4,908,609 3/1990 Stroomer ..... 340/784
4,943,802 7/1990 Kuijk ..... 340/784
4,950,058 8/1990 Diem et al. ..... 340/784
4,969,718 11/1990 Noguchi et al. ..... 340/784

FOREIGN PATENT DOCUMENTS 63-85599 4/1988 Japan .

*Primary Examiner*—Richard Hjerpe
*Assistant Examiner*—Xiao M. Wu
*Attorney, Agent, or Firm*—Fitzpatrick, Cella, Harper & Scinto

[57] ABSTRACT

An image display apparatus, having a pixel configuration in which pixels on the n-th line and pixels on the n+1-th line are deviated in the horizontal direction, improves the resolution in the horizontal direction by changing over an image signal to be sampled between a delay signal DL and a through signal TH supplied from a delay circuit so as to deviate the image signal by a time corresponding to the deviation of the pixels. By sampling the image signal which corresponds to each line while deviating the image signal by the time which corresponds to the deviation of the pixels in the horizontal direction, the deviation between the pixel and the signal is eliminated, so that the resolution in the horizontal direction is improved.

8 Claims, 17 Drawing Sheets

FIG. 1(a)
| | | | | |
|---|---|---|---|---|
| R | G | B | R | G |
| R | G | B | R | G |
| R | G | B | R | G |
| R | G | B | R | G |
FIG. 1(b)
| | | | | |
|---|---|---|---|---|
| R | G | B | R | G |
| G | B | R | G | B |
| B | R | G | B | R |
| R | G | B | R | G |
FIG. 2
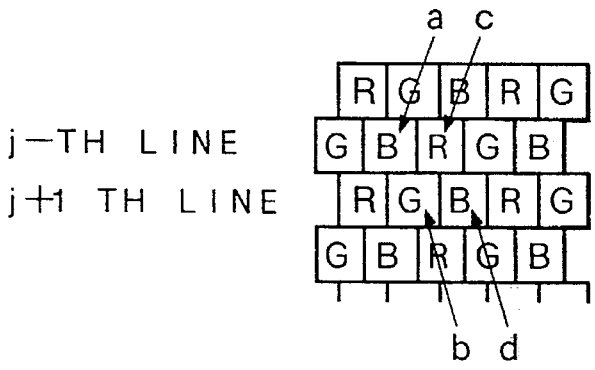
FIG. 3
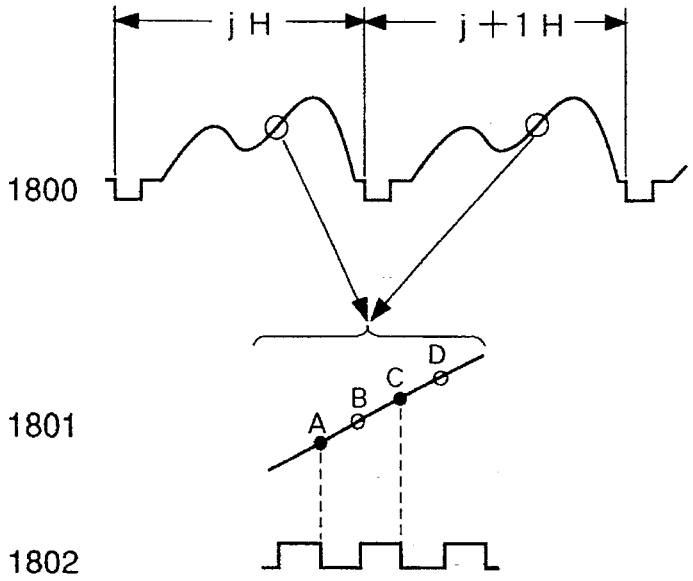

METHOD OF DRIVING IMAGE DISPLAY APPARATUS

This application is a continuation of application Ser. No. 08/389,073 filed Feb. 14, 1995, now abandoned, which is a continuation of application Ser. No. 08/010,003 filed Jan. 27, 1993, now abandoned.

BACKGROUND OF THE INVENTION

1. Field of the Invention

The present invention relates to a method of driving an image display apparatus, and more particularly to a method of driving an image display apparatus especially suitable for an active matrix liquid display apparatus for example.

2. Description of the Prior Art

Examples of known configurations of pixels in a color image display apparatus which uses a liquid crystal are shown in FIGS. 1(*a*) and 1(*b*). Referring to FIGS. 1(*a*) and 1(*b*), symbols R, G and B respectively denote red, green and blue pixels.

In the configuration shown in FIG. 1(*a*) , the same color pixels are arranged in the longitudinal (vertical) direction, and red, green and blue pixels are alternately arranged in the horizontal direction. On the contrary, the configuration shown in FIG. 1(*b*) is arranged in such a manner that red, green and blue pixels are alternately arranged in both of the longitudinal and the horizontal directions.

However, the configuration shown in FIG. 1(*a*) encounters problems in that the resolution of the displayed lines and pixels is unsatisfactory in the longitudinal direction in which the same color pixels are positioned sequentially, and the apparent color separation capability or the apparent color resolution in the longitudinal direction is unsatisfactory. With the configuration shown in FIG. 1(*b*), the fact that the same color pixels are arranged sequentially in the diagonal direction downwards to the left causes a problem to arise in that the resolution of the displayed lines and the pixels is unsatisfactory in the aforesaid diagonal direction and the apparent color separation capability or the apparent color resolution is unsatisfactory in the aforesaid direction.

The reason for this will now be described. A large area is occupied by a pixel set which is composed of one red, one green and one blue pixel in the perpendicular direction. In the case shown in FIG. 1(*a*) constituted in such a manner that one dot is displayed by three pixels arranged in the horizontal direction, that is, one red, one green and one blue pixels, then, for example, two pixels, that is, the green and blue pixels, are invariably present where a red dot is displayed. Therefore, the red dots are displayed at intervals of two pixels, causing a problem to arise in that the realized resolution is unsatisfactory.

In order to compensate for the aforesaid problems, a configuration arranged as shown in FIG. 2 has been suggested. That is, the aforesaid configuration has pixels, the positions of which are deviated from one another from line to line, and the red, green and blue pixels are alternately arranged in the horizontal direction, so that a sequential arrangement of the same color pixels in the longitudinal, horizontal and diagonal directions is inhibited. As a result, the red, green blue pixels are disposed equally, so that the aforesaid problems can be overcome. It should be noted that the horizontal directional deviation between a pixel on the j-th line and that on the j+1 line is made to be ½ pixel.

A method of driving an image display apparatus, in which the pixels are arranged as shown in FIG. 2, will now be described.

In the column direction, image data is transmitted as a drive signal from a drive circuit. Referring to FIG. 3, reference numeral 1800 represents an image signal to be used as a TV signal. Referring to FIG. 3, a jH-th (H is the period of the horizontal synchronizing signal) image signal and a (j+1)H-th image signal are positioned adjacently and generally represent substantially the same image data in an ordinary signal.

Referring to FIG. 3, reference numeral 1801 represents a signal expressed by enlarging the signal 1800. Reference numeral 1802 represents a sampling clock signal for sampling image data, the sampling clock signal 1082 having a period which is the same as the time corresponding to one pixel. Thus, sampling is performed at the trailing transitions of the sampling clock.

Therefore, image data A and C are written on pixels a and c on the j-th line and pixels b and d on the j+1-th line, causing the problem to arise in that the resolution of the image substantially deteriorates in the horizontal direction, i.e. the pixels have a deviation from line to line that is not accommodated in the sampled signal.

SUMMARY OF THE INVENTION

Accordingly, an object of the present invention is to provide an image display apparatus capable of improving the resolution in the horizontal direction, the image display apparatus having a pixel configuration arranged in such a manner that pixels on the n-th line and those on the n+1-th line are deviated from each other in the horizontal direction as shown in FIG. 2.

Another object of the present invention is to provide a method of driving an image display apparatus capable of sampling image signals, which correspond to the lines, while deviating the sampling time in a manner which corresponds to the deviation of the pixels in the horizontal direction, and which is therefore capable of improving the resolution in the horizontal direction.

Another object of the present invention is to provide a method of driving an image display apparatus having a first pixel array including a plurality of pixels arranged to form columns and a second pixel array including pixels disposed adjacent to respective pixels of the first pixel array and deviated therefrom in a predetermined direction, the method of driving an image display apparatus comprising the steps of: performing sampling of image data while delaying the sampling timing of the image data to be supplied to the second pixel array from the sampling timing of the image data to be supplied to the first pixel array in accordance with the deviation between the pixels of the first pixel array and those of the second pixel array; and displaying an image by supplying the sampled image data to the first and the second pixel array.

Another object of the present invention is to provide a method of driving an image display apparatus in which pixels on the n+1-th line are deviated from pixels on the n-th line by a deviation of z pixels in the horizontal direction, where the period of the deviation of the pixels in the horizontal direction is y lines (two or more lines), the method of driving an image display apparatus comprising the steps of: receiving an image signal having a plurality of frames each constituted by y fields; and deviating the phase of the sampling timing in each of the y fields by zt (t being the time which corresponds to one pixel in the horizontal direction).

Another object of the present invention is to provide a method of driving an image display apparatus in which pixels on the n+1-th line are deviated from pixels on the n-th line by a deviation of z pixels in the horizontal direction and the period of the deviation of the pixels in the horizontal direction is y lines (two or more lines), and which has y−1 delay circuits each having a respective delay quantity that is a respective integral multiple of zt (t being the time corresponding to one pixel in the horizontal direction), and which are provided for an image signal line of a sampling circuit thereof, the method of driving an image display apparatus comprising: sequentially changing over y switches, which change over between a delay signal and a through signal transmitted from each of the delay circuits, at a period of y lines at each pixel line.

Another object of the present invention is to provide a method of driving an image display apparatus in which pixels on the n+1-th line are deviated from pixels on the n-th line by a deviation of z pixels in the horizontal direction and the period of the deviation of the pixels in the horizontal direction is y lines (two or more lines), and which has y−1 delay circuits each having a respective delay quantity that is a respective integral multiple of zt (t being the time corresponding to one pixel in the horizontal direction), and which are provided for an image signal line of a sampling circuit to which an image signal having a plurality of frames each constituted by y fields is supplied, the method of driving an image display apparatus comprising sequentially changing over y switches, which change over between a delay signal and a through signal transmitted from each of the delay circuits, at a period of y lines at each field.

These and further objects, features and advantages of the invention will be appear more fully from the following description.

BRIEF DESCRIPTION OF THE DRAWINGS

FIGS. 1(*a*), 1(*b*), and 2 respectively are schematic configuration views which illustrate different configurations of pixels;

FIG. 3 illustrates an example of a method of driving an image display apparatus, in which the configuration of the pixels is as shown in FIG. 2;

DESCRIPTION OF THE PREFERRED EMBODIMENTS

Figure 4:
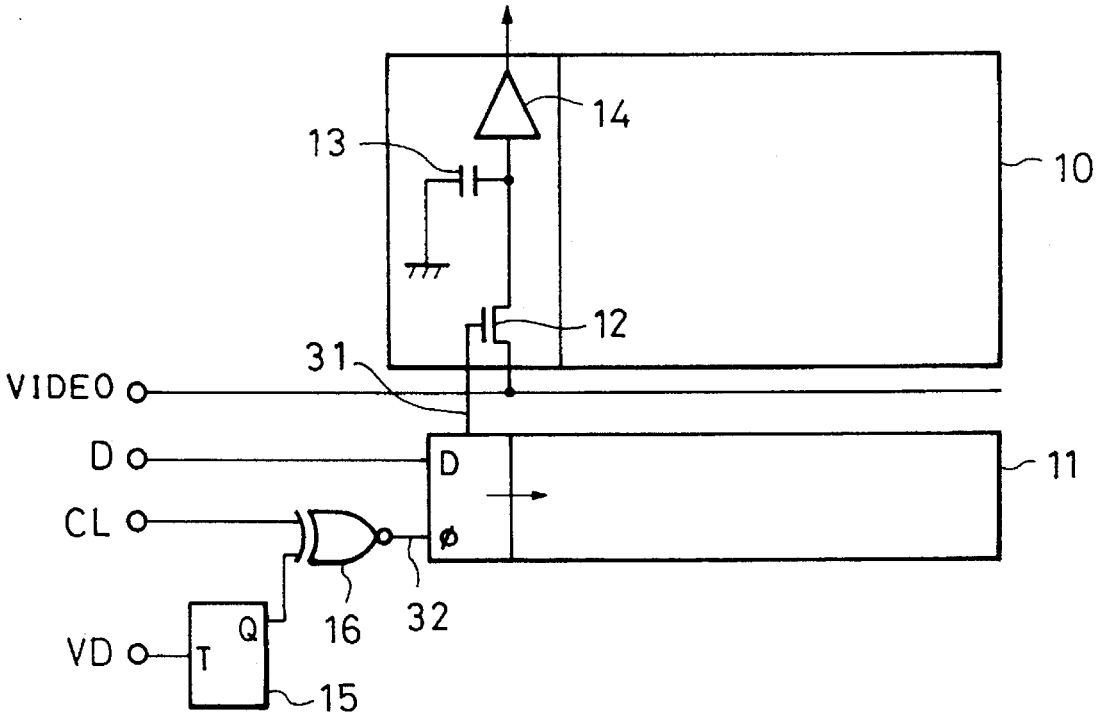
FIGS. 4, 7, 12, 17 and 26 respectively are schematic circuit diagrams which illustrate examples of sample circuits according to the present invention.

In order to overcome the aforesaid problems, in an image display apparatus in which pixels on the n-th line and pixels on the n+1-th line are disposed so as to be deviated in the horizontal direction, the present invention provides that sampling of pixels on the n-th line and sampling of pixels on the n+1-th line are performed while deviating the timing of the sampling operations to correspond to the deviation of the pixels in the horizontal direction.

That is, with reference to FIGS. 2 and 3, image data A of an image signal at jH is written to pixel a on the j-th line shown in FIG. 2 and image data C of the image signal is written to pixel c shown in FIG. 2. Since pixels on the (j+1)-th line are deviated from pixels on the j-th line by ½ pixel in the horizontal direction, image data B and D at (j+1) should be written to pixels b and d shown in FIG. 2 on the (j+1)-th line. However, the fact that image data is always sampled at the trailing transition of a sampling clock 1802 causes image data at A and C times to be written on pixels b and d shown in FIG. 2 similarly to sampling made on the j-th line. Therefore, the resolution of the image in the lateral direction deteriorates substantially.

Accordingly, an object of the present invention is to overcome the aforesaid problems by changing the data sampling timing.

According to one aspect of the present invention, there is provided a method of driving an image display apparatus in which pixels on the n+1-th line are deviated from pixels on the n-th line by a deviation of z pixels in the horizontal direction, where the period of the deviation of the pixels in the horizontal direction is y lines (two or more lines), the method of driving an image display apparatus comprising the steps of: receiving an image signal having a plurality of frames each constituted by y fields; and deviating the phase of the sampling timing in each of the y fields by zt (t being the time which corresponds to one pixel in the horizontal direction).

According to another aspect of the present invention, there is provided a method of driving an image display apparatus in which pixels on the n+1-th line are deviated from pixels on the n-th line by a deviation of z pixels in the horizontal direction and the period of the deviation of the pixels in the horizontal direction is y lines (two or more lines), and which has y−1 delay circuits each having a respective delay quantity that is a respective integral multiple of zt (t being the time corresponding to one pixel in the horizontal direction), and which are provided for an image signal line of a sampling circuit thereof, the method of driving an image display apparatus comprising: sequentially changing over y switches, which change over between a delay signal and a through signal transmitted from each of the delay circuits, at a period of y lines at each pixel line.

According to another aspect of the present invention, there is provided a method of driving an image display apparatus in which pixels on the n+1-th line are deviated from pixels on the n-th line by a deviation of z pixels in the horizontal direction and the period of the deviation of the pixels in the horizontal direction is y lines (two or more lines), and which has y−1 delay circuits each having a respective delay quantity that is a respective integral multiple of zt (t being the time corresponding to one pixel in the horizontal direction), and which are provided for an image signal line of a sampling circuit to which an image signal having a plurality of frames each constituted by y fields is supplied, the method of driving an image display apparatus comprising: sequentially changing over y switches, which change over between a delay signal and a through signal transmitted from each of the delay circuits, at a period of y lines at each field.

According to another aspect of the present invention, there is provided a method of driving an image display apparatus having a first pixel array including a plurality of pixels arranged to form columns and a second pixel array including pixels disposed adjacent to respective pixels of the first pixel array and deviated therefrom in a predetermined direction, the method of driving an image display apparatus comprising the steps of: performing sampling of image data while delaying the sampling timing of the image data to be supplied to the second pixel array from sampling timing of image data to be supplied to the first pixel array in accordance with the deviation between the pixels of the first pixel array and those of the second pixel array; and displaying an image by supplying the sampled image data to the first and the second pixel array.

Embodiments of the present invention will now be described.

Figure 5:
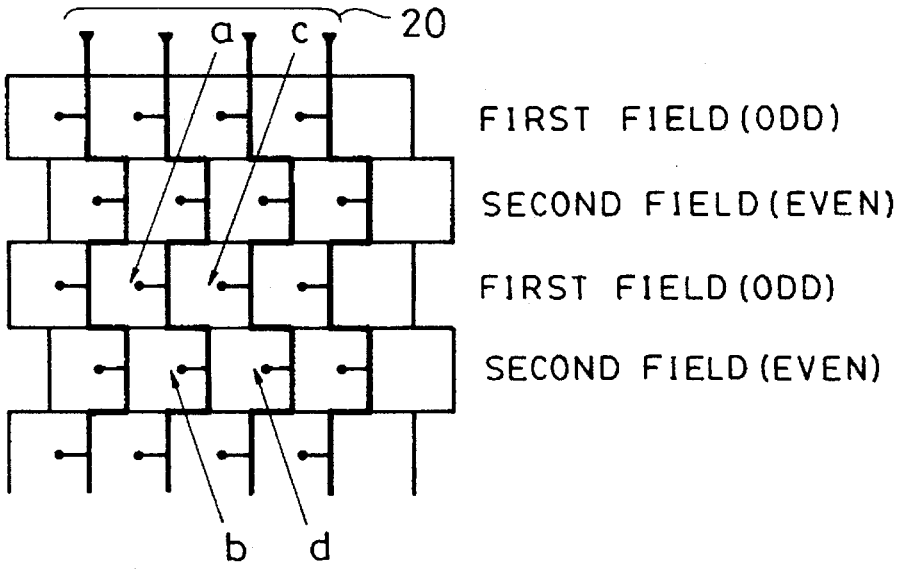
FIGS. 5, 8, 10, 13, 15, 18, 20, 24 and 27 respectively are schematic pixel configuration views which illustrate examples of pixel configurations according to the present invention.
Figure 6A:
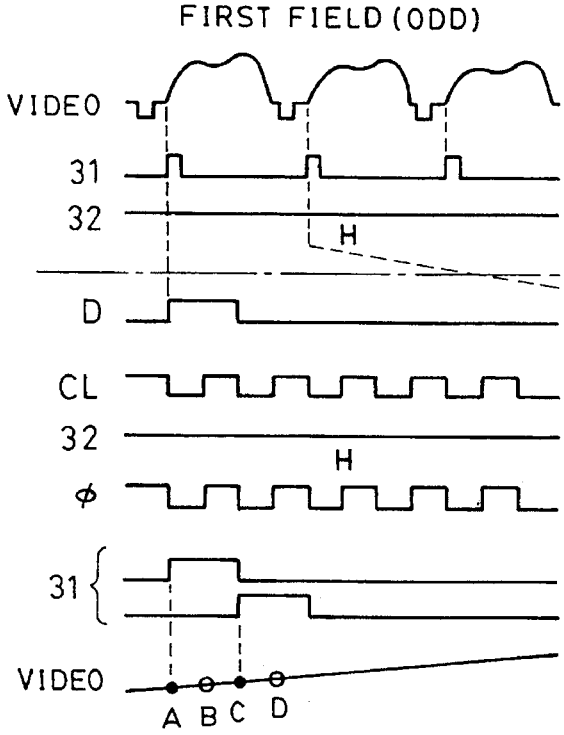
FIGS. 6(*a*), 6(*b*), 9(*a*), 9(*b*), 11(*a*), 11(*b*), 14, 16, 19(*a*), 19(*b*), 21(*a*), 21(*b*), 25(*a*), 25(*b*), 25(*c*), 28(*a*), 28(*b*) and 28(*c*) respectively are schematic timing charts which illustrate the timing of signals according to the present invention.
Figure 6B:
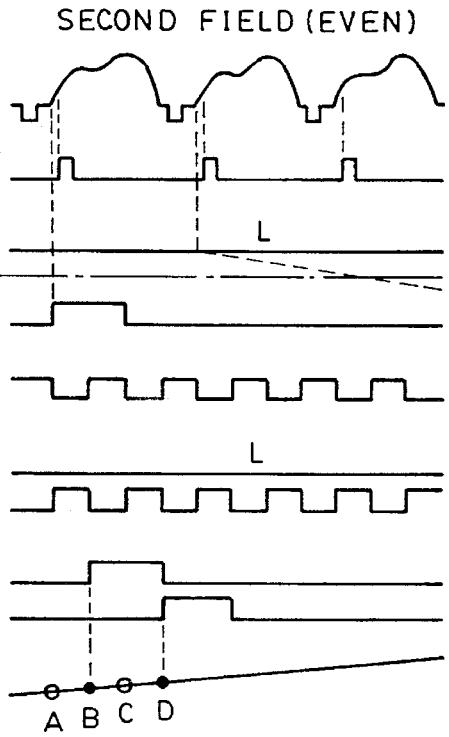

FIGS. 4 to 6(*b*) illustrate a first embodiment of the present invention. In this embodiment, a sample holding circuit shown in FIG. 4 drives pixels, the configuration of which is made as shown in FIG. 5.

Referring to FIG. 4, reference numeral 10 represents a sample holding circuit, the first stage of which is composed of a sampling transistor 12, a capacitor 13 and a buffer amplifier 14. The sampling transistor 12 has a gate to which a control signal 31 is transmitted from each stage of a shift register 11. One terminal of the sampling transistor 12 is connected to an image signal Video line, while the other terminal is connected to a capacitor 13, the opposite terminal of which is grounded. An output terminal of the sample holding circuit 10 is connected to a signal line 20 shown in FIG. 5.

The operation of the first embodiment will now be described. In response to the control signal 31 supplied from each stage of the shift register 11, the sampling transistor 12 is turned on, causing subject image data to be written on the capacitor 13. In accordance with image data written on the capacitor 13, the buffer amplifier 14 generates column direction drive signals.

Reference numeral 11 represents the shift register which transfers an input timing signal D with a shift clock $\phi$ so as to transmit the control signal 31.

Reference numeral 15 represents a T flip-flop which receives pulses VD (the width of which is determined arbitrarily) at a period of one field, so that an output signal 32 is inverted at each field.

Symbol CL represents a transferring clock signal, the period of which corresponds to the time of one pixel. An XOR gate 16 receives the transferring clock signal CL and the output signal 32 transmitted from the T flip-flop 15.

As shown in FIG. 5, this embodiment is arranged in such a manner that pixels on the n-th line are respectively deviated from pixels on the n+1-th line in the horizontal direction by ½ pixel. The period of the aforesaid deviation of the pixels is made to be 2 lines. The pixels on every other line are sectioned into first fields and second fields and receive image signals which have frames each constituted by a first field and a second field. Thus, an interlace drive is performed in which signals, each of which is formed by sampling the image signal in the first field, are written to odd pixel lines and signals, each of which is formed by sampling the images signal in the second field, are written to even pixel lines. The signal line 20 is commonly connected to each digit of the first and the second fields.

Referring to FIGS. 6(*a*) and 6(*b*), a portion below an alternate long and short dash line shows its upper portion connected thereto by a dashed line while enlarging the aforesaid upper portion. In the first field shown in FIG. 6(*a*), the output signal 32 transmitted from the T flip-flop 15 is high level, and the transferring clock signal CL and the shift clock $\phi$ are in phase, so that the control signal 31 is transmitted from the shift register 11 simultaneously with the output of an input timing signal D from the shift register 11. As a result, image data is sampled in a sequential order of A and C. On the other hand, in the second field shown in FIG. 6(*b*), the output signal 32 transmitted from the T flip-flop 15 is low level, and the phase of the shift clock $\phi$ is inverted from that of the transferring clock signal CL. Hence, the control signal 31 transmitted from the shift register 11 is deviated from the input timing signal D by a half period. In response to the deviated control signal 31, image data is sampled in a sequential order of B and D.

Therefore, a column directional drive signal can be transmitted to each pixel in the second field which is deviated from each pixel in the first field by ½ pixel, while deviating the column directional drive signal to a degree corresponding to the deviation of the pixels. As a result, the horizontal directional resolution can be improved. Signals A to D shown in FIGS. 6(*a*) and 6(*b*) correspond to pixels a to d shown in FIG. 5.

Figure 7:
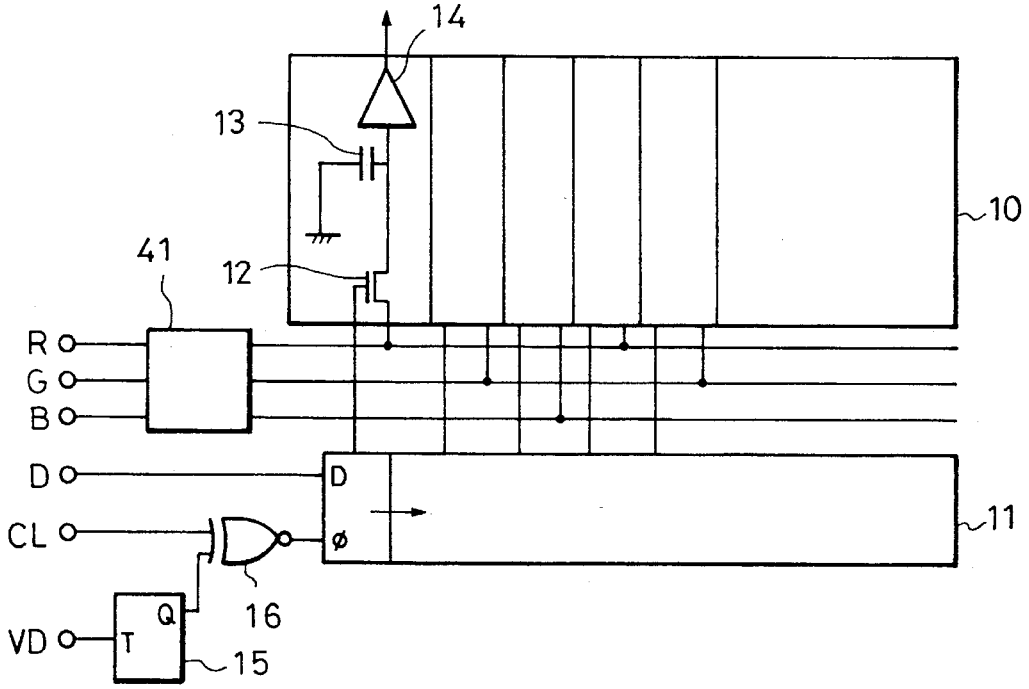
Figure 8:
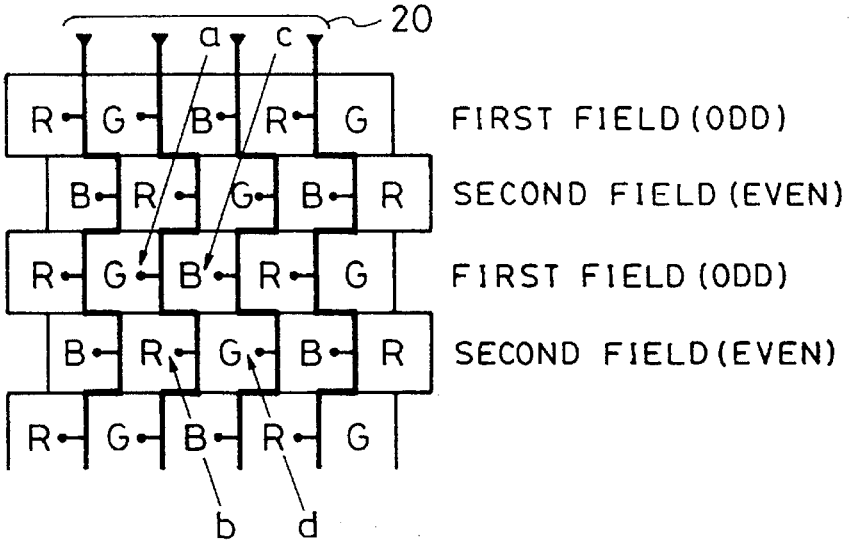
Figure 9A:
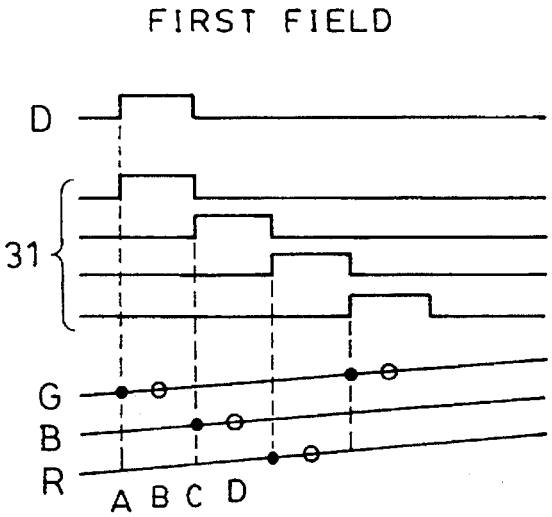
Figure 9B:
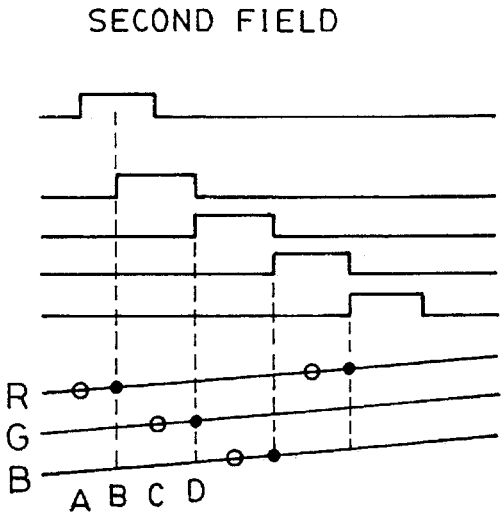

FIGS. 7 to 9(*b*) illustrate a second embodiment of the present invention which is adapted to a color display operation.

More specifically, a sample holding circuit according to this embodiment is, as shown in FIG. 7, provided with a multiplexer 41, so that the multiplexer 41 cyclically changes the connection order of the three primary color signals, that is, red, green and blue color signals, at each horizontal directional period in accordance with the arrangement of the color filters in the horizontal direction of the pixels.

Furthermore, the pixels are, as shown in FIG. 8, deviated at each line similarly to the structure as described above with reference to FIG. 2. In addition, the red, green and blue pixels are alternately arranged, so that the same color pixels are not positioned adjacent to each other in the longitudinal, horizontal and diagonal directions. The configuration of the aforesaid pixels is arranged in such a manner that pixels on the n-th line and those on the n+1-th line are deviated from one another by ½ pixel. Furthermore, the period of the deviation of the pixels is two lines. In addition, the pixels on the alternate lines are sectioned into first fields and second fields and receive image signals which are constituted of frames each including a first field and a second field. Thus, an interlace drive is performed in which signals, each of which is formed by sampling the image signal in the first field, are written to odd pixel lines and signals, each of which is formed by sampling the image signal in the second field, are written to even pixel lines.

The sampling timing according to this embodiment is arranged as shown in FIGS. 9(*a*) and 9(*b*) and is similar to that according to the first embodiment except for the fact that the red, green and blue signals are sampled individually in both the first field (see FIG. 9(*a*)) and the second field (see FIG. 9(*b*)), resulting in a similar effect. The same reference numerals and symbols shown in FIGS. 7 to 9(*b*) represent the same elements and signals shown in FIGS. 4 to 6(*b*).

Figure 10:
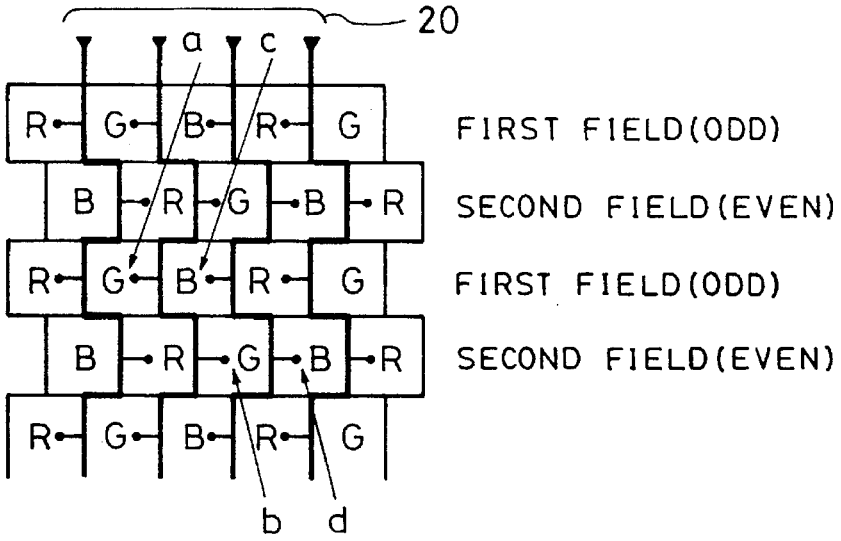
Figure 11A:
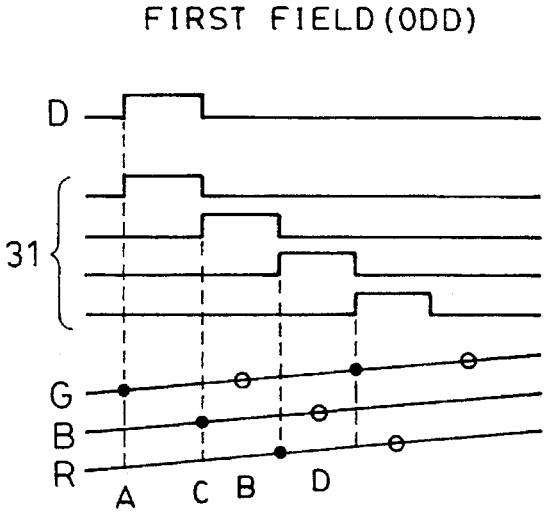
Figure 11B:
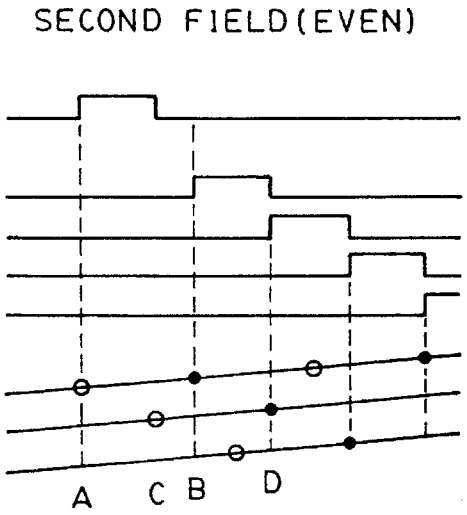

FIGS. 10, 11(*a*) and 11(*b*) illustrate a third embodiment of the present invention in which the configuration of the pixels is the same as that according to the second embodiment, but the difference lies in the way of connecting the signal line 20 and the pixels. Here the connection is made in such a manner that pixels of the same color filter are connected to the same signal line 20 so as to be driven thereby. Therefore, the pixels connected to the same signal line 20 are arranged in such a manner that pixels on the n+1-th line are deviated from those on the n-th line in the horizontal direction by 1.5 pixel. Hence, the timing of sampling the second field (see FIG. 11(*b*)) with respect to that of sampling the first field (see FIG. 11(*a*)) is deviated by the time which corresponds to 1.5 pixel, that is, it is deviated from the input timing signal D by 1.5 period.

Figure 12:
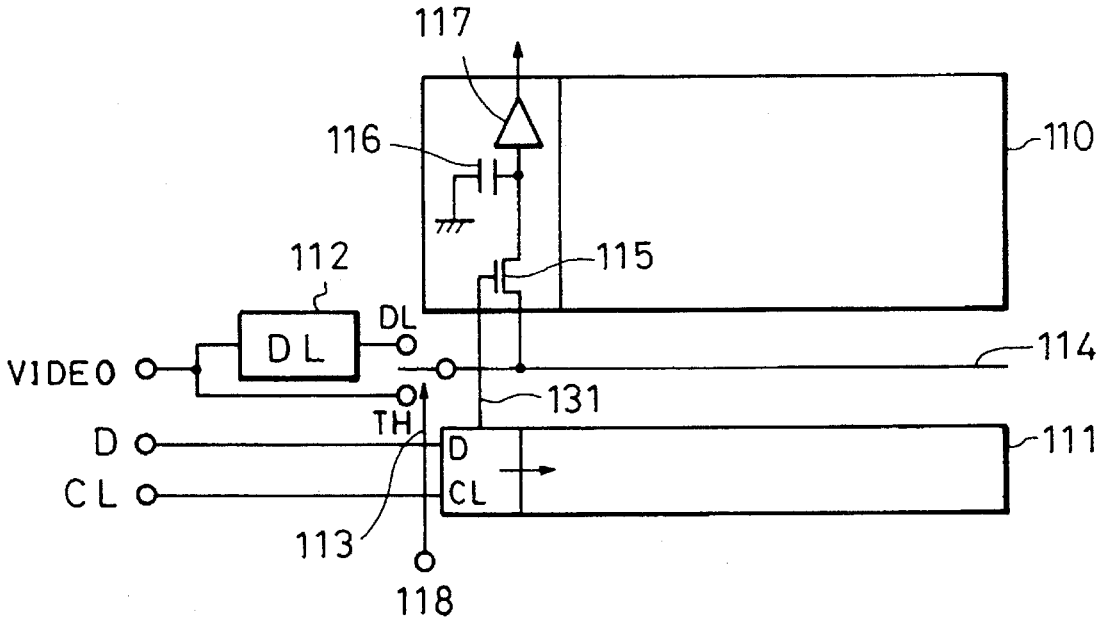
Figure 13:
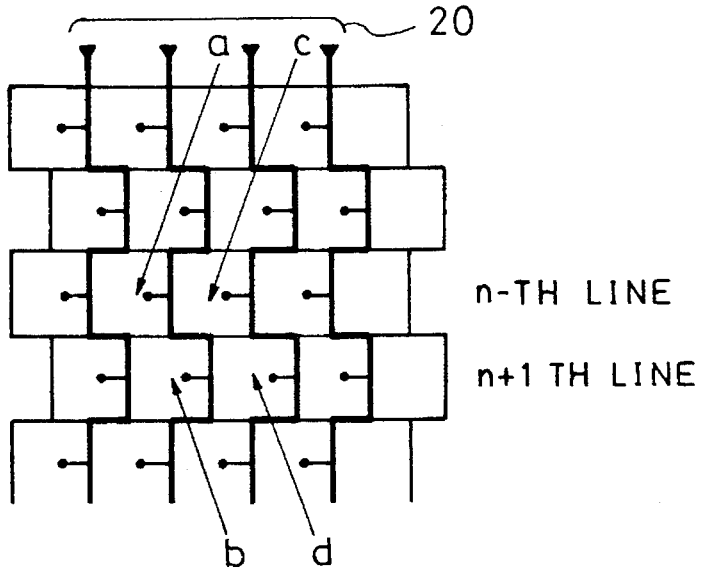
Figure 14:
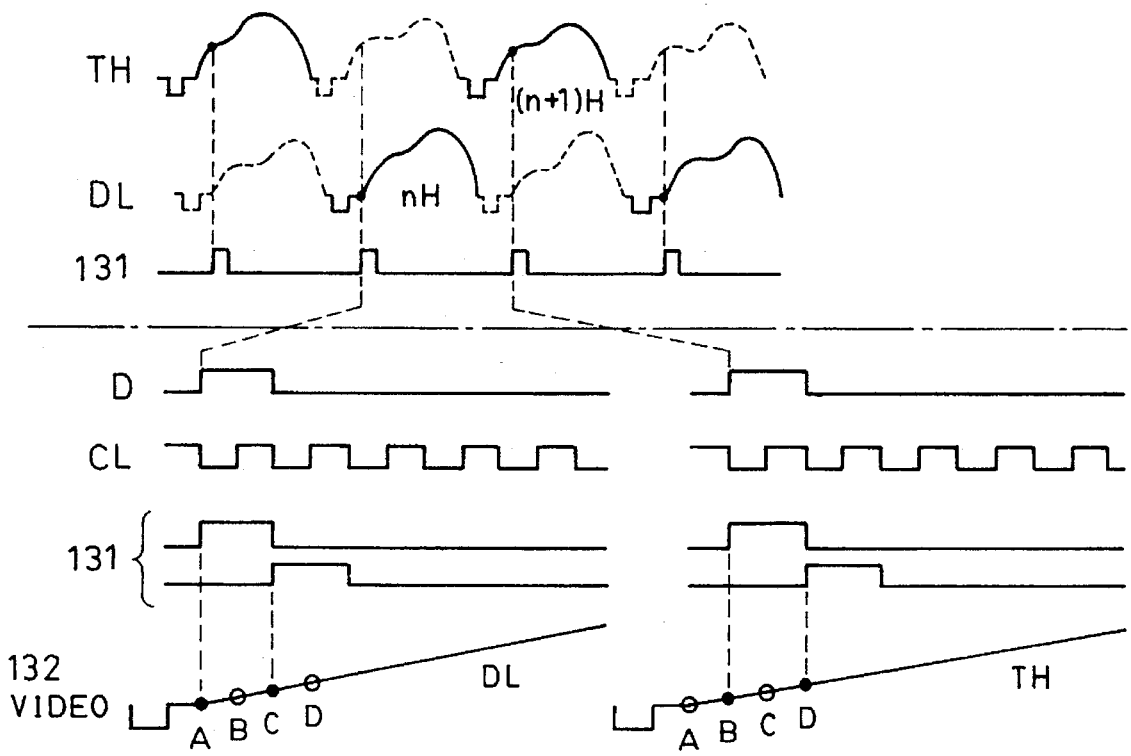

FIGS. 12 to 14 illustrate a fourth embodiment of the present invention, wherein a sampling circuit shown in FIG. 12 drives each of the pixels arranged as shown in FIG. 13.

Referring to FIG. 12, reference numeral 110 represents a sample holding circuit, the first stage of which is composed of a sampling transistor 115, a capacitor 116 and a buffer amplifier 117. The sampling transistor 115 has a gate to which a control signal 131 is transmitted from each stage of a shift register 111. A terminal of the sampling transistor 115 is connected to an image signal line 114, while another terminal is connected to the capacitor 116, a terminal of which is grounded. An output terminal of the sample holding circuit 110 is connected to a signal line 20 shown in FIG. 13.

The operation of the fourth embodiment will now be described. In response to the control signal 131 supplied from each stage of the shift register 111, the sampling transistor 115 is turned on, causing subject image data to be written on the capacitor 116. In accordance with image data written on the capacitor 116, the buffer amplifier 117 generates image signals for driving the pixels.

Shift register 111 transmits the control signal 131 in accordance with an input timing signal S and a transferring clock signal CL. The period of the transferring clock signal CL corresponds to the time of one pixel.

The image signal line 114 is connected to a delay circuit 112, and a switch 113 for changing over a delay signal DL transmitted from the delay circuit 112 and a through signal TH. The delay circuit 112 according to this embodiment has a delay quantity of ½ t (t is the time which corresponds to one pixel in the horizontal direction). The switch 113 is changed over at every other line in response to a timing signal 118.

As shown in FIG. 13, the pixels according to this embodiment are formed in such a manner that pixels on the n+1-th line are deviated from pixels on the n-th line by ½ pixel in the horizontal direction, and this deviation of the pixels takes place every other line. Furthermore, a signal line 20 is commonly connected to the same column of each line.

Referring to FIG. 14, the portion below the alternate long and short dash line shows an enlarged view of the upper portion between the dashed lines. As shown in FIG. 14, the signal for a pixel at (n+1)H (H is the period of the horizontal synchronizing signal) is always sampled in response to the through signal TH, while the signal for a pixel at nH is always sampled in response to a delay signal. Therefore, signals for the pixels on the n-th line are always sampled while being delayed from the signals for the pixels on the n+1-th line by ½t (t is the time which corresponds to a horizontal directional position pixel). Hence, writing of pixels designated by symbols a, b, c and d shown in FIG. 2 is correctly performed while being freed from deviation in accordance with image data sampled at timings of A, B, C and D.

Therefore, an image signal can be transmitted to each pixel on the n+1-th line deviated from each pixel on the n-th line by ½ pixel in the horizontal direction, the image signal being deviated by the time which corresponds to the deviation of the pixels. As a result, the resolution in the horizontal direction can be improved.

Figure 15:
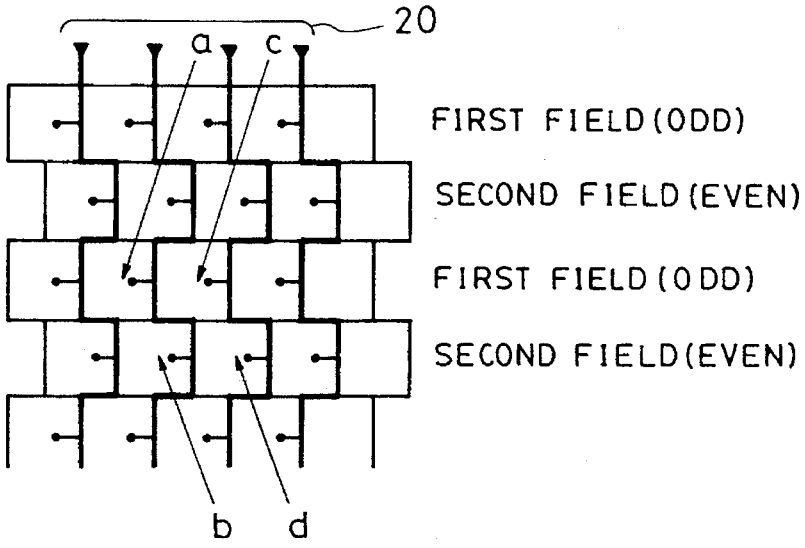
Figure 16:
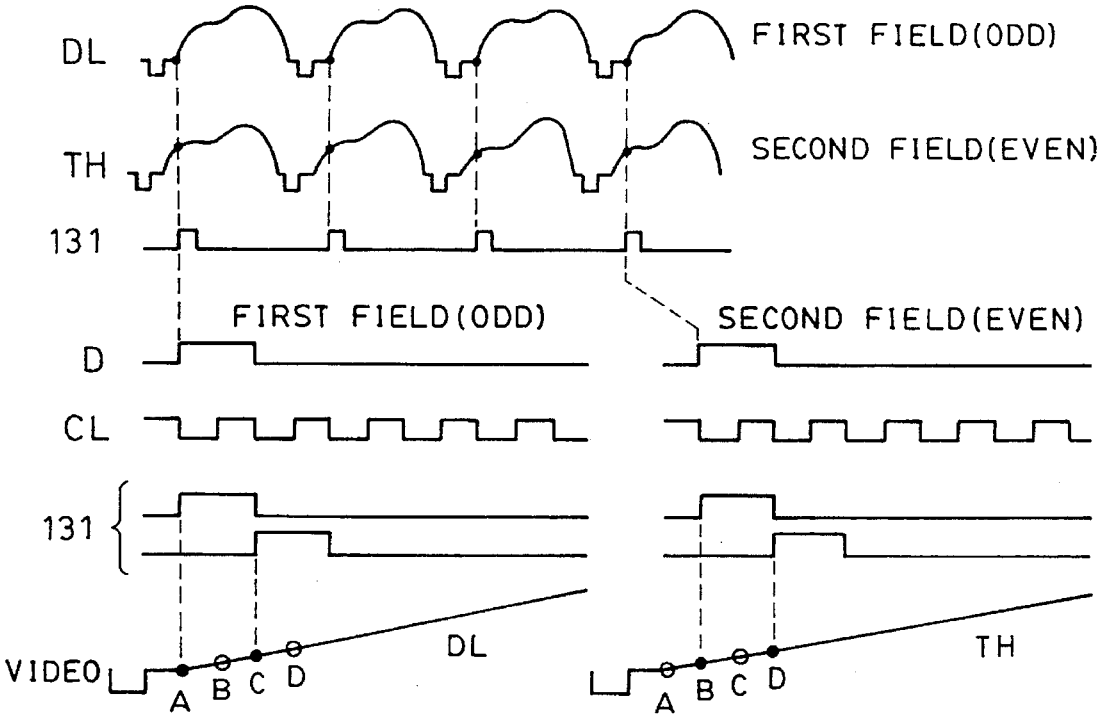

FIGS. 15 and 16 illustrate a fifth embodiment of the present invention which is arranged basically similarly to that shown in FIGS. 12 to 14, wherein the same reference numerals represent the same elements or signals.

Here also the horizontal directional deviation period of pixels is made to be two lines similarly to the embodiment shown in FIGS. 12 to 14. In accordance with the aforesaid pixel deviation period, the pixels are sectioned into the two fields, that is, the first and the second periods as shown in FIG. 15, so that an interlace drive is performed in response to image signals which are arranged with the two fields forming one frame, the interlace drive being an operation in which signals obtained by sampling the image signals of the first field are written on the odd pixel lines and signals obtained by sampling the images signals of the second field are written on the even pixel lines.

In this case, the switch 113 shown in FIG. 12 changes over the through signal TH and the delay signal DL at each field as shown in FIG. 16, causing each pixel in the first field to be sampled in response to an image signal, which is delayed by the time which corresponds to ½ pixel from each pixel in the second field. Hence, writing of pixels designated by symbols a, b, c and d shown in FIG. 15 is performed correctly while being freed from deviation in accordance with image data sampled at the timing of each of A, B, C and D shown in FIG. 16.

Figure 17:
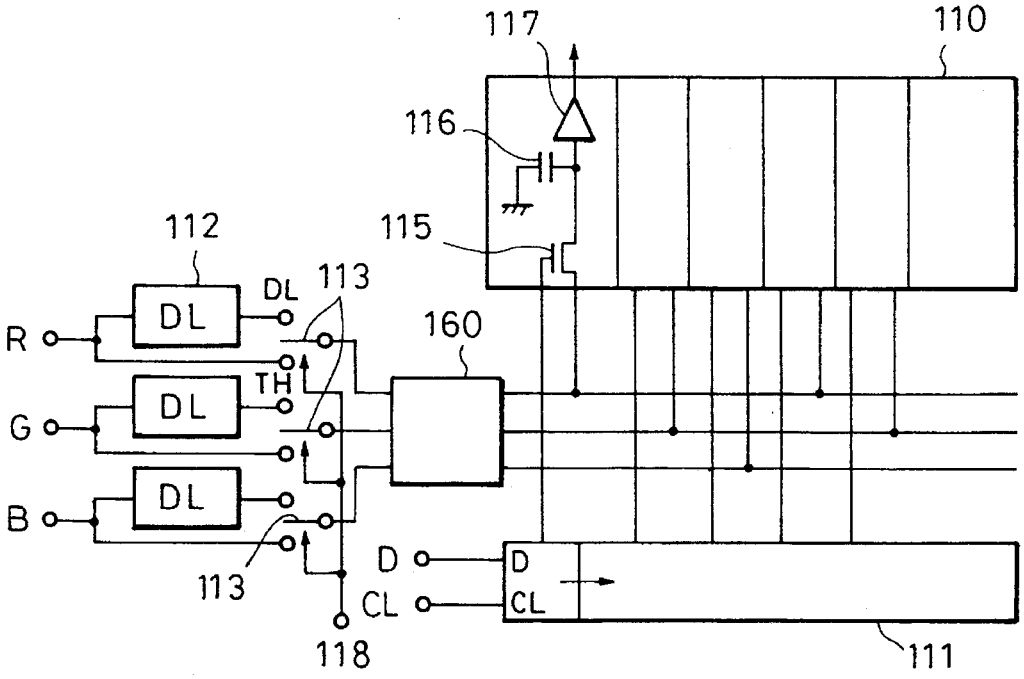
Figure 18:
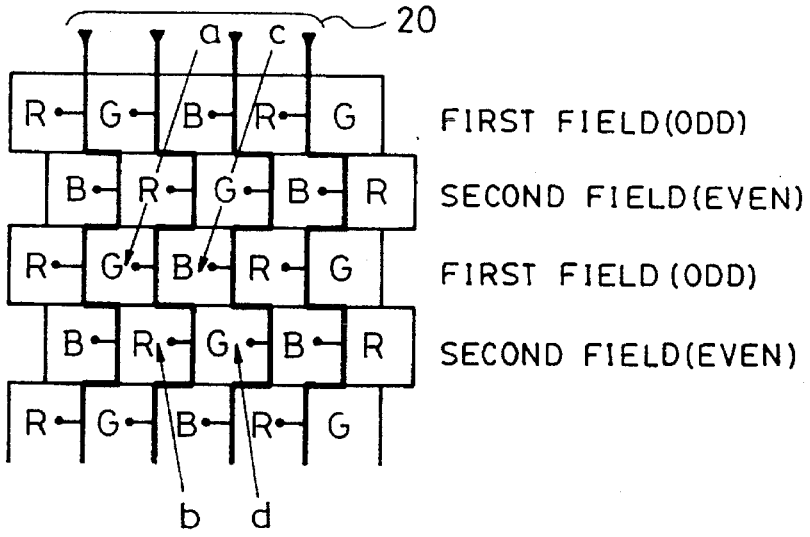
Figure 19A:
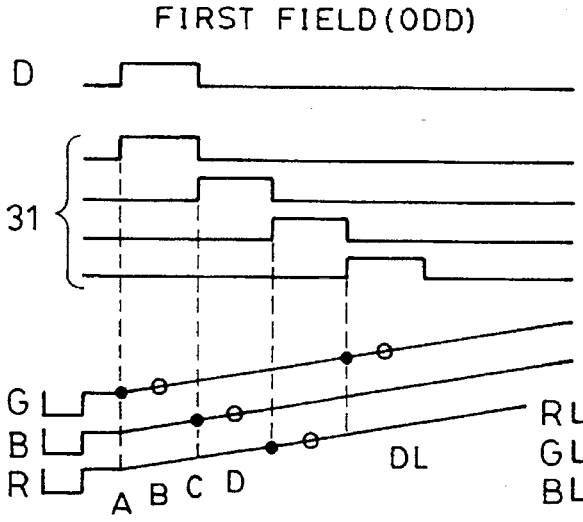
Figure 19B:
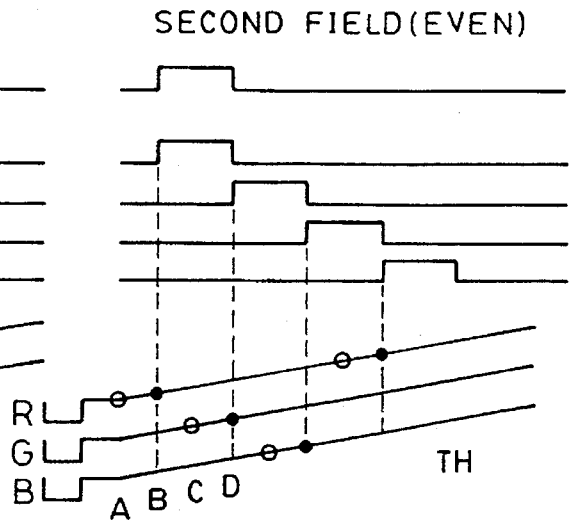

FIGS. 17 to 19(*b*) illustrate a sixth embodiment of the present invention which is adapted to a color display operation.

More specifically, a sample holding circuit according to this embodiment is, as shown in FIG. 17, provided with a multiplexer 160, so that the multiplexer 160 cyclically changes the connection order of the three primary color signals, that is, red, green and blue color signals at each horizontal directional period in accordance with the arrangement of the color filter in the horizontal direction of the pixels. Furthermore, the three primary color signals, that is, the red, green and blue signals, are changed over while being formed into the delay signals DL or the through signals TH by a delay circuit 112 and a switch 113 constituted similarly those described with reference to FIG. 12, so that the red, green and blue signals are supplied to the multiplexer 160.

Furthermore, the pixels are, as shown in FIG. 18, deviated at each line similarly to the structure as described above with reference to FIG. 2. In addition, the red, green and blue pixels are alternately arranged, so that the same color pixels are not positioned adjacent to each other in the longitudinal, horizontal and diagonal directions. The configuration of the aforesaid pixels is arranged in such a manner that pixels on the n-th line and those on the n+1-th line are deviated from one another by ½ pixel. Furthermore, the period of the deviation of the pixels is two lines. In addition, the pixels on the alternate other lines are sectioned into first fields and second fields and receive image signals which are constituted by the first field and the second field as one frame. Thus, an interlace drive is performed in which signals, each of which is formed by sampling the image signal in the first field, are written to odd pixel lines and signals, each of which is formed by sampling the image signal in the second field, are written to even pixel lines.

The sampling timing according to this embodiment is arranged as shown in FIGS. 19(*a*) and 19(*b*) and is similar to that according to the fifth embodiment except for the fact that sampling of the red, green and blue signals are sampled individually in both the first field (see FIG. 19(*a*)) and the second field (see FIG. 19(*b*)), resulting in a similar effect to be obtained. The same reference numerals and symbols shown in FIGS. 17 to 19(*b*) represent the same elements and signals shown in FIGS. 12 to 14.

Figure 20:
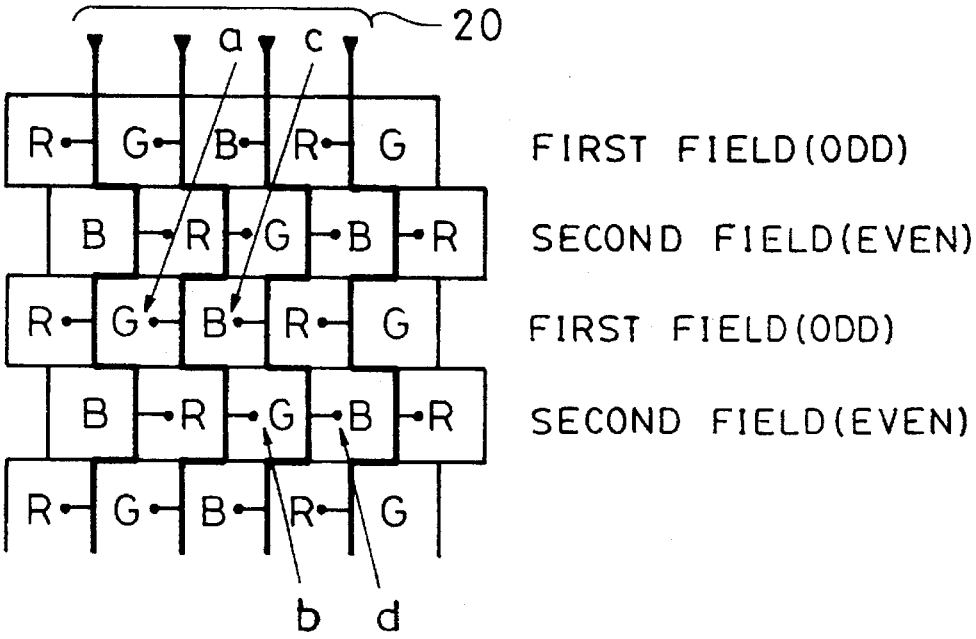
Figure 21A:
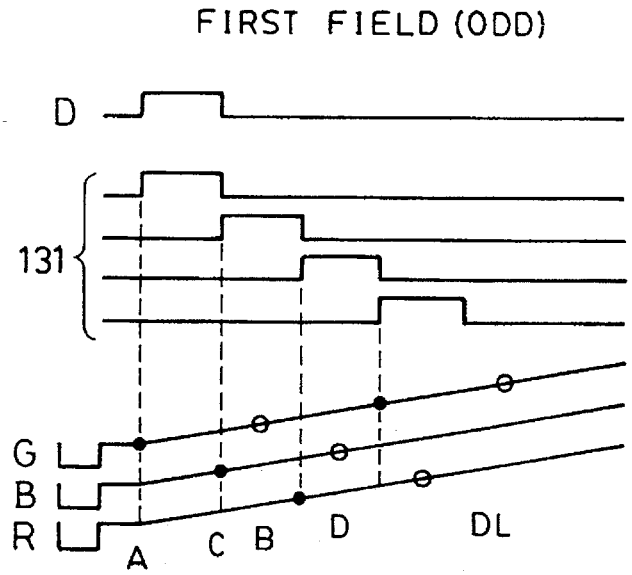
Figure 21B:
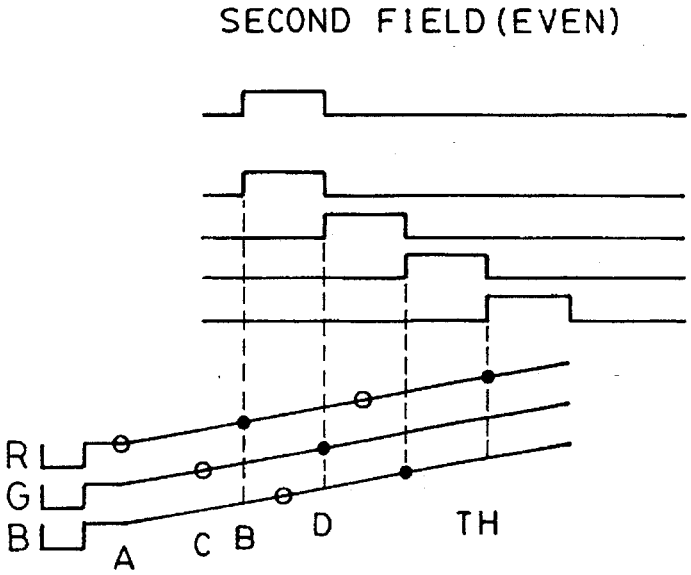

FIGS. 20, 21(*a*) and 21(*b*) illustrate a seventh embodiment of the present invention, wherein the configuration of the pixels is the same as that according to the sixth embodiment, but the difference lies in the way of connecting the signal line 20 and the pixels. Here the connection is made in such a manner that pixels of the same color filter are connected to the same signal line 20 so as to be driven thereby. Therefore, the pixels connected to the same signal line 20 are arranged in such a manner that pixels on the n+1-th line are deviated from those on the n-th line in the horizontal direction by 1.5 pixel. Hence, the delay signal is delayed from the through signal by a time which corresponds to 1.5 pixel in order to deviate the image signal sampled in the first field (FIG. 21(*a*) ) from that in the second field (see FIG. 21(*b*)) by the time which corresponds to 1.5 pixel.

Although the deviation is made to be ½ pixel or 1.5 pixel in the aforesaid first to the seventh embodiments, the present invention is not limited to the aforesaid quantity of deviation. It is apparent that the present invention can be adapted to another quantity of deviation.

Although the first to the seventh embodiments employ an interlace drive, the present invention is not limited to an interlace drive, but can be adapted to a non-interlace drive.

Figure 22:
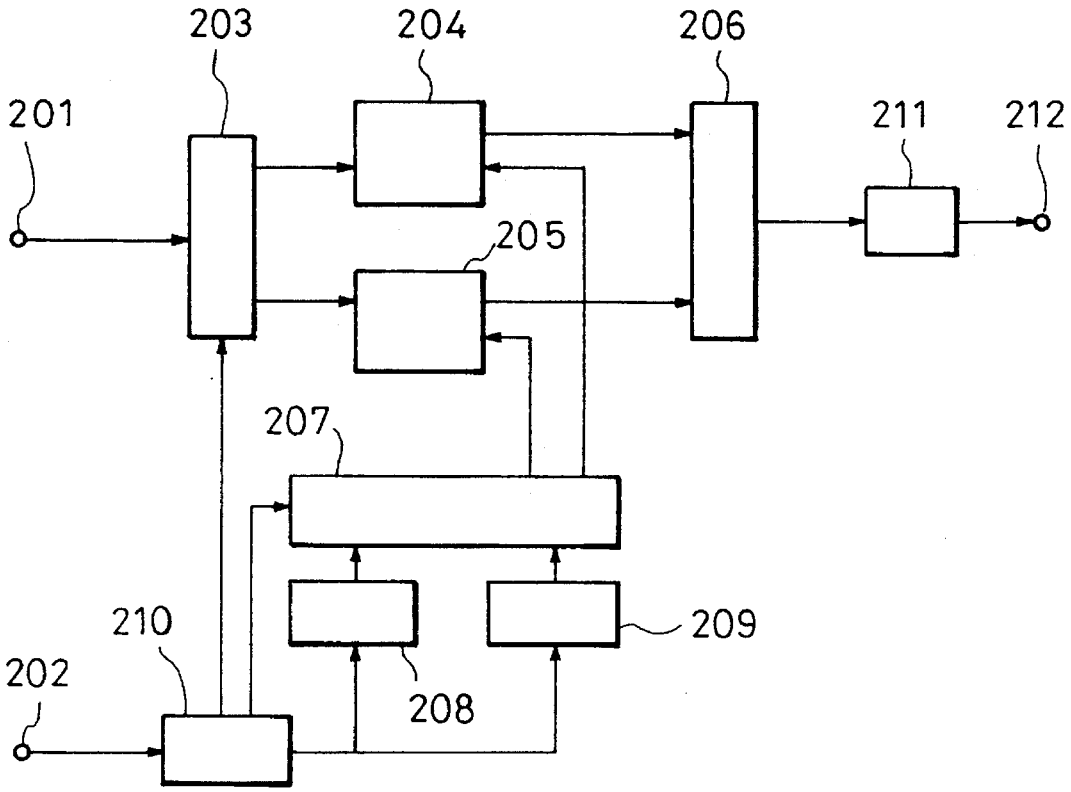
FIG. 22 is a schematic block diagram which illustrates an example of a non-interlace drive circuit to which the present invention can be adapted.

FIG. 22 is a block diagram which illustrates a non-interlace drive circuit, in which image signals are supplied from an image signal input terminal 201 to a demultiplexer 203. The demultiplexer 203 causes the image signals in the first and the second fields to be written in a first memory circuit 204 and a second memory circuit 205.

The image signals stored in the first memory circuit 204 and the second memory circuit 205 are synthesized into one frame by a multiplexer 206 before being transmitted to an image signal output terminal 212 via a polarity inverting circuit 211.

A writing address generating circuit 208 supplies writing address signals to the first and the second memory circuits 204 and 205 via an address switch circuit 207 in each writing period for the first memory circuit 204 and the second memory circuit 205.

A reading address generating circuit 209 supplies reading address signals to the first and the second memory circuits 204 and 205 via the address switch circuit 207 in each writing period for the first memory circuit 204 and the second memory circuit 205.

The address switch circuit 207 performs switching between the writing address and the reading address in accordance with whether each of the first and the second memory circuits 204 and 205 is in a writing period or a reading period.

A synchronizing signal generating circuit 210 supplies a timing signal required for each circuit based upon a synchronizing signal applied thereto from outside via a synchronizing signal input terminal 202.

Figure 23:
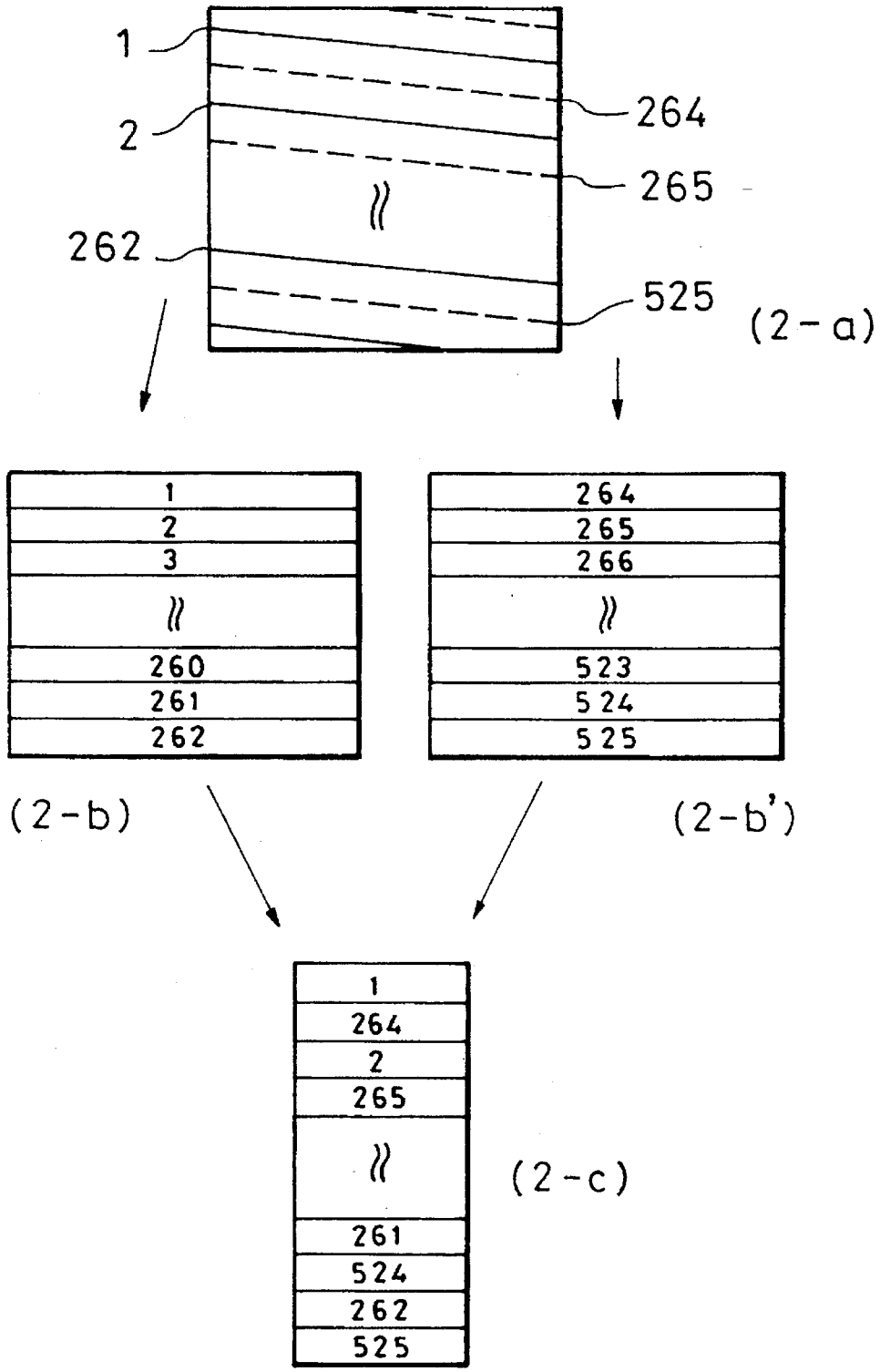
FIG. 23 is a view which illustrates the relationship between an image signal for use in the circuit shown in FIG. 22 and writing and reading made with respect to the first and the second memory circuits.

FIG. 23 illustrates the relationship between the image signals and the writing operation and reading operation to and from the first and the second memory circuits 204 and 205.

Reference numeral (2-*a*) represents an image signal arranged in accordance with the conventional 525/60 standard for use in the NTSC-M method.

The skip operation image signal (2-*a*) is written to the first and the second memory circuits 204 and 205 while being formed into, for example, signals (2-*b*) and (2-*b*'). Numerals 1 to 525 shown in FIG. 23 denote the No. of the scanning line. In the illustrated case, the first field and the second field correspond to (2-*b*) and (2-*b*') respectively.

In the case where the image signals are read afterwards from the first and the second memory circuits 204 and 205, they are read while shortening the lateral (horizontal) directional scanning period by half. The vertical scanning order is made in such a manner that the first line of the second memory circuit 205 (which corresponds to the 264-th line in the skip scanning operation) is read after the first line of the first memory circuit 204 has been read, and the second line (which similarly corresponds to the 265-th line) of the second memory circuit 205 is read after the second line of the first memory circuit 204 has been read. The aforesaid scanning operation is repeated sequentially.

The image signals thus read form a non-interlace image while being formed into, for example, signal (2-*c*).

In the aforesaid embodiment, the sampling timing at the time of the reading operation to be performed between the first memory circuit 204 and the second memory circuit 205 is deviated by the time which corresponds to the horizontal directional deviation of the pixels, so that an image can be obtained in which flicker is restricted, which is an advantage of the non-interlace operation, while maintaining the resolution in the horizontal direction.

Figure 24:
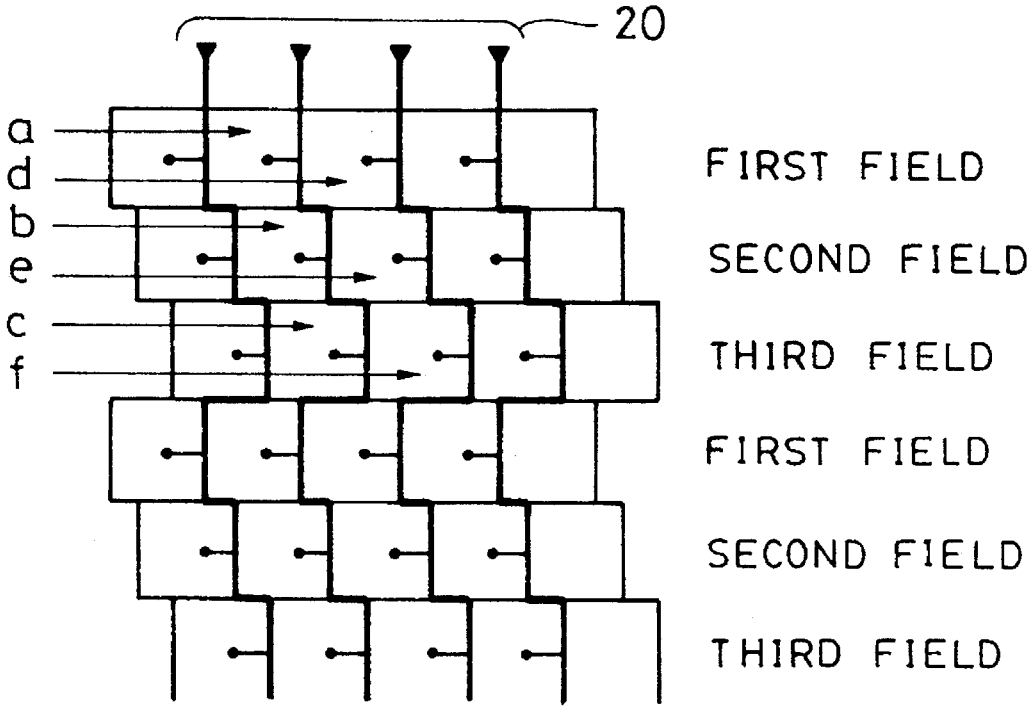
Figure 25A:
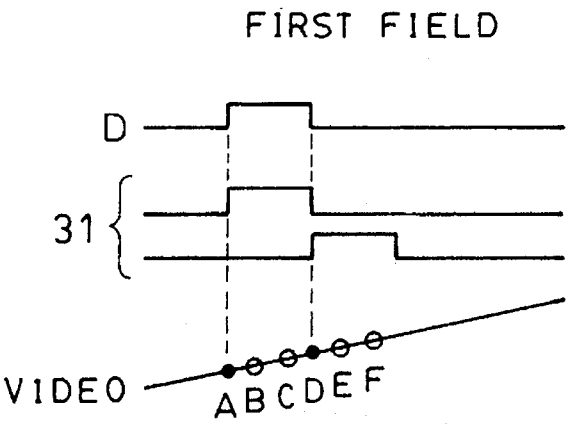
Figure 25B:
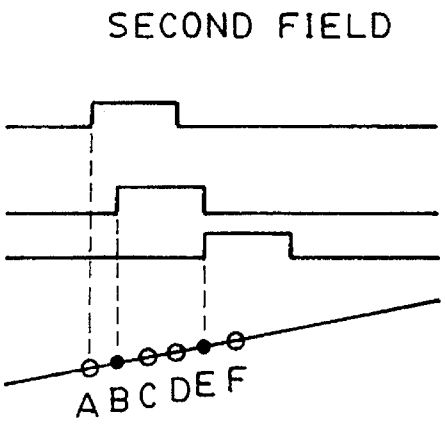
Figure 25C:
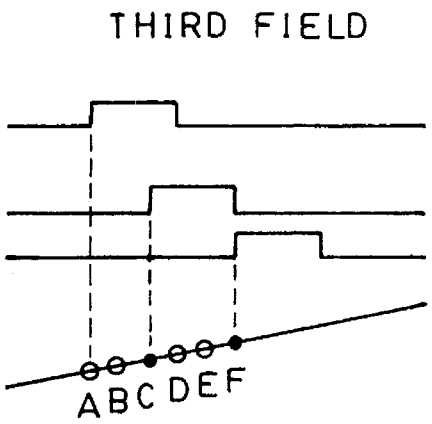

FIGS. 24 and 25(*a*) to 25(*c*) illustrate an eighth embodiment of the present invention, in which the pixels are, as shown in FIG. 24, deviated in such a manner that the pixels on the n+1-th line are deviated from the pixels on the n-th line by ⅓ pixel in the horizontal direction, and the period of the deviation of the pixels is three lines. In addition, the pixels on every group of three lines are sectioned into first, second and third fields and receive image signals which are constituted of frames each including the first, second and third fields. As a result, writing to each field is performed in such a manner that writing to the first, the fourth and the seventh, . . . , lines, writing to the second, the fifth and the eighth, . . . , lines, and writing to the third, the sixth and the ninth lines, . . . , are performed. The signal line 20 is commonly connected to every other pixel of the first, the second and the third fields.

The driving timing according to this embodiment is arranged as shown in FIGS. 25(*a*) to 25(*c*) in such a manner that the control signal 31 transmitted by the shift register 11 (see FIG. 12) is deviated at each field by ⅓ period with respect to the input timing signal D, so that the first, second and third fields are driven while each is deviated by a time corresponding to ⅓ pixel.

In the aforesaid embodiment, the image signal to be sampled at the time of the operation of writing data between the first memory circuit 104 and the second memory circuit 105 is deviated by the time which corresponds to the horizontal directional deviation of the pixels, so that an image can be obtained in which flicker is restricted, which is an advantage of non-interlace operation, while maintaining the resolution in the horizontal direction.

Figure 26:
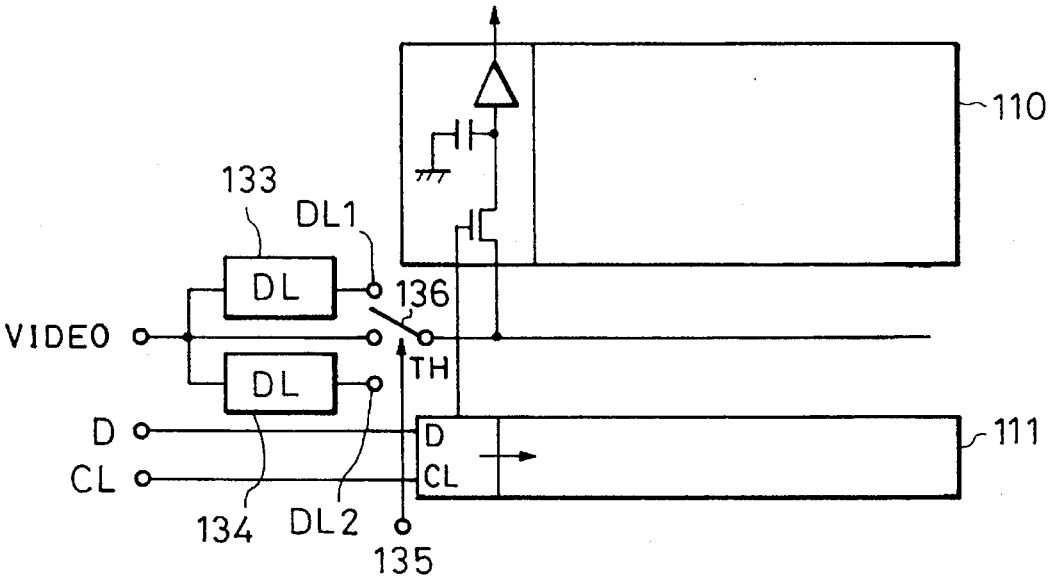
Figure 27:
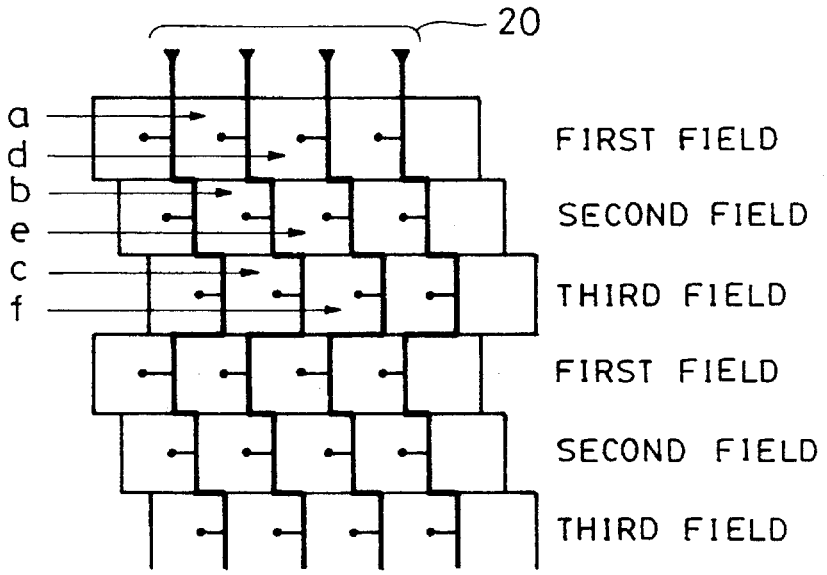
Figures 28A, 28B, 28C:
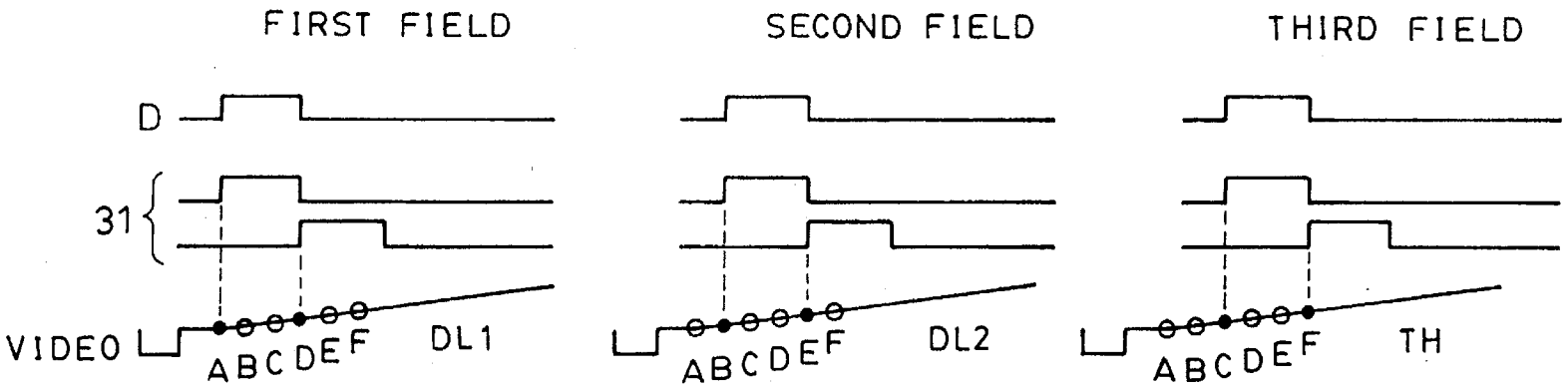

FIGS. 26 to 28(*c*) illustrate a ninth embodiment of the present invention, in which the pixels are, as shown in FIG. 27, deviated in such a manner that the pixels on the n+1-th line are deviated from the pixels on the n-th line by ⅓ pixel in the horizontal direction, and the period of the deviation of the pixels is made to be three lines. In addition, the pixels on every other two lines are sectioned into first, second and third fields and receive image signals which are constituted by frames each including the first, second and third fields. As a result, writing to each field is performed in such a manner that writing to the first, the fourth and the seventh, . . . , lines, writing to the second, the fifth and the eighth, . . . , lines, and writing to the third, the sixth and the ninth lines, . . . , are performed. The signal line 20 is commonly connected to every other pixel of the first, second and third fields.

In order to be adaptable to the image configuration thus made, the sampling circuit has two delay circuits 133 and 134 as shown in FIG. 26, the delay circuit 133 having a delay quantity of ⅔t (t is the time which corresponds to one pixel in the horizontal direction), while the delay circuit 134 a delay quantity of ⅓t. A switch 136 switches a delay signal DL1 transmitted from the delay circuit 133, a delay signal DL2 transmitted from the delay circuit 134, and a through signal TH. The switch 136 performs the aforesaid switching operation at a period of three fields (one frame) for each field in response to timing pulses 135.

As shown in FIGS. 28(*a*) to 28(*c*), the driving timing is made in such a manner that the first field (see FIG. 28(*a*)), the second field (see FIG. 28(*b*)) and the third field (see FIG. 28(*c*)) are, in this order, sequentially subjected to sampling performed from image signals, which are respectively deviated by ⅓t. As a result, writing to pixels a to f shown in FIG. 27 is correctly performed while being freed from deviation in accordance with image data sampled at the timing of A to F shown in FIGS. 28(*a*) to 28(*b*).

Although the aforesaid embodiments are arranged in such a manner that the pixel deviation period is two or three lines and the image signals for two or three fields constitute one frame, other period and field structures may be employed to perform the driving operation according to the present invention.

As described above, according to the present invention, sampling of the image signal corresponding to each line can be performed while being deviated by the time which corresponds to the deviation of the pixels in the horizontal direction, so that the resolution in the horizontal direction can be improved.

What is claimed is:

1. A method of driving an image display apparatus having a plurality of horizontal lines of pixels, in which pixels on an n+1-th line are deviated from pixels on an n-th line by a deviation of z pixels in the horizontal direction, the deviation of said pixels in the horizontal direction being periodic with a period of y lines, where y is two or more, and which has y−1 delay circuits each having a respective delay quantity that is a respective integral multiple of zt, where t is a time corresponding to one pixel in the horizontal direction, the delay circuits being provided for an image signal line of a sampling circuit thereof, and which has y switches, said method of driving an image display apparatus comprising the steps of:

transmitting from each delay circuit a through signal and a delay signal delayed from the through signal by the delay quantity; and sequentially changing over the y switches to change over between the delay signal and the through signal transmitted from each of said delay circuits at a period of y lines at each pixel line.

2. A method of driving an image display apparatus having a plurality of horizontal lines of pixels, in which pixels on an n+1-th line are deviated from pixels on an n-th line by a deviation of z pixels in the horizontal direction, the deviation of said pixels in the horizontal direction being periodic with a period of y lines, where y is two or more, and which has y−1 delay circuits each having a respective delay quantity that is a respective integral multiple of zt, where t is the time corresponding to one pixel in the horizontal direction, the delay circuits provided for an image signal line of a sample circuit to which is supplied an image signal having a plurality of frames each constituted by y fields, which has y switches, said method of driving an image display apparatus comprising the steps of:

transmitting from each delay circuit a through signal and a delay signal delayed from the through signal by the respective delay quantity; and sequentially changing over the y switches to change over between the delay signal and the through signal transmitted from each of said delay circuits at a period of y lines at each field.

3. A method of driving an image display apparatus including a pixel matrix having a plurality of lines of pixels, wherein each pixel on an n-th line and a corresponding pixel on an n+1-th line are connected to a same signal line, and wherein each pixel on the n+1-th line is arranged with a horizontal deviation of Z pixels with respect to the corresponding pixel on the n-th line, said method comprising the steps of:

sampling an image signal to provide a first sample and inputting the first sample to a first pixel on the n-th line; and sampling the image signal to provide a second sample and inputting the second sample to a corresponding second pixel on the n+1-th line connected to the same signal line as the first pixel with a time delay of Z pixels relative to the first sample.

4. A method of driving an image display apparatus according to claim 3, wherein said image display apparatus is a liquid crystal display apparatus.

5. A method of driving an image display apparatus according to claim 3, wherein pixels connected to the same signal line are pixels of a same color.

6. A method of driving an image display apparatus according to claim 3, wherein pixels connected to the same signal line are pixels of different colors.

7. A method of driving an image display apparatus having a plurality of horizontal lines of pixels, in which pixels on an n+1-th line are deviated from pixels on an n-th line by a deviation of z pixels in the horizontal direction, the deviation of said pixels in the horizontal direction being periodic with a period of y lines, where y is two or more, and which has y−1 delay circuits each having a respective delay quantity that is a respective integral multiple of zt, where t is a time corresponding to one pixel in the horizontal direction, the delay circuits being provided for an image signal line of a sampling circuit thereof, and which has a switch, said method of driving an image display apparatus comprising the steps of:

transmitting from each delay circuit a through signal and a delay signal delayed from the through signal by the delay quantity; and changing over the switch to sequentially change over between the delay signal and the through signal transmitted from each of said delay circuits.

8. A method of driving an image display apparatus having a plurality of horizontal lines of pixels, in which pixels on an n+1-th line are deviated from pixels on an n-th line by a deviation of z pixels in the horizontal direction, the deviation of said pixels in the horizontal direction being periodic with a period of y lines, where y is two or more, and which has y−1 delay circuits each having a respective delay quantity that is a respective integral multiple of zt, where t is the time corresponding to one pixel in the horizontal direction, the delay circuits provided for an image signal line of a sample circuit to which is supplied an image signal having a plurality of frames each constituted by y fields, which has a switch, said method of driving an image display apparatus comprising the steps of:

transmitting from each delay circuit a through signal and a delay signal delayed from the through signal by the respective delay quantity; and changing over the switch to sequentially change over between the delay signal and the through signal transmitted from each of said delay circuits.

* * * * *

UNITED STATES PATENT AND TRADEMARK OFFICE

CERTIFICATE OF CORRECTION

PATENT NO. : 5,579,027

DATED : November 26, 1996

INVENTORS : KATSUHITO SAKURAI ET AL.

It is certified that error appears in the above-identified patent and that said Letters Patent is hereby corrected as shown below:

COLUMN 2

Line 12, "1082" should read --1802--.

COLUMN 5

Line 60, "images" should read --image--.

COLUMN 7

Line 3, "pixel." should read --pixels.--;
Line 5, "pixel," should read --pixels,--;
Line 6, "period." should read --periods.-.

COLUMN 8

Line 65, "sampling" should read --samplings--.

COLUMN 9

Line 13, "pixel." should read --pixels.;

UNITED STATES PATENT AND TRADEMARK OFFICE

CERTIFICATE OF CORRECTION

PATENT NO. : 5,579,027

DATED : November 26, 1996

INVENTORS : KATSUHITO SAKURAI ET AL.

It is certified that error appears in the above-identified patent and that said Letters Patent is hereby corrected as shown below:

COLUMN 9 continued

Line 15, "pixel" should read --pixels--;
Line 18, "pixel." should read --pixels.--;
Line 19, "pixel" (last occurrence) should read --pixels--.

Signed and Sealed this

Fifth Day of August, 1997

Bruce Lehman

*Attest:*

BRUCE LEHMAN

*Attesting Officer*

*Commissioner of Patents and Trademarks*